US007589632B2

(12) United States Patent
Ott

(10) Patent No.: US 7,589,632 B2
(45) Date of Patent: Sep. 15, 2009

(54) METHODS AND DEVICES FOR PROTECTING AN ARTICLE AGAINST THEFT

(76) Inventor: Reinhold Ott, 6 Willow Street, Unit 2203, Waterloo, Ontario (CA) N2J 4S3

( * ) Notice: Subject to any disclaimer, the term of this patent is extended or adjusted under 35 U.S.C. 154(b) by 280 days.

(21) Appl. No.: 10/543,088

(22) PCT Filed: Jan. 20, 2004

(86) PCT No.: PCT/EP2004/000386

§ 371 (c)(1),
(2), (4) Date: May 15, 2006

(87) PCT Pub. No.: WO2004/066235

PCT Pub. Date: Aug. 5, 2004

(65) Prior Publication Data

US 2007/0001845 A1 Jan. 4, 2007

(30) Foreign Application Priority Data

Jan. 23, 2003 (DE) ..... 103 02 537

(51) Int. Cl.
*G08B 13/14* (2006.01)

(52) U.S. Cl. ..... 340/568.1; 340/571; 340/687

(58) Field of Classification Search ... 340/568.1–568.8, 340/571, 686.1–687
See application file for complete search history.

(56) References Cited

U.S. PATENT DOCUMENTS 5,072,213 A * 12/1991 Close ..... 340/568.2
5,245,317 A 9/1993 Allen et al.
5,543,782 A * 8/1996 Rothbaum et al. ..... 340/568.2
5,552,771 A * 9/1996 Leyden et al. ..... 340/568.2
5,570,080 A * 10/1996 Inoue et al. ..... 340/571

(Continued)

FOREIGN PATENT DOCUMENTS

DE 3632966 A1 9/1986

(Continued)

OTHER PUBLICATIONS

International Search Report—PCT/ISA/201 (German and English), Jun. 15, 2004.

(Continued)

*Primary Examiner*—George A Bugg
(74) *Attorney, Agent, or Firm*—Harness, Dickey & Pierce, P.L.C.

(57) ABSTRACT

The invention relates to methods and devices for protecting an article against theft. Once a protection element is in the on-position (100), a selection signal is transmitted from an emitter to a receiver provided in the protection element, in order to associate the protection element with the emitter and to shift said protection element into a connection mode (110). The receiver is then deactivated (111) in the connection mode (110). The deactivation (111) of the receiver reduces the energy consumption of the protection element, and prevents the protection element from unintentionally receiving other selection signals. Once the protection element has been shifted (112) into an alarm state (120), for example, due to an attempted theft, the receiver thereof is reactivated, in order to reauthorize the reception of a selection signal. The alarm state (120) can be terminated (123) by one such selection signal.

28 Claims, 7 Drawing Sheets

Figure 1:
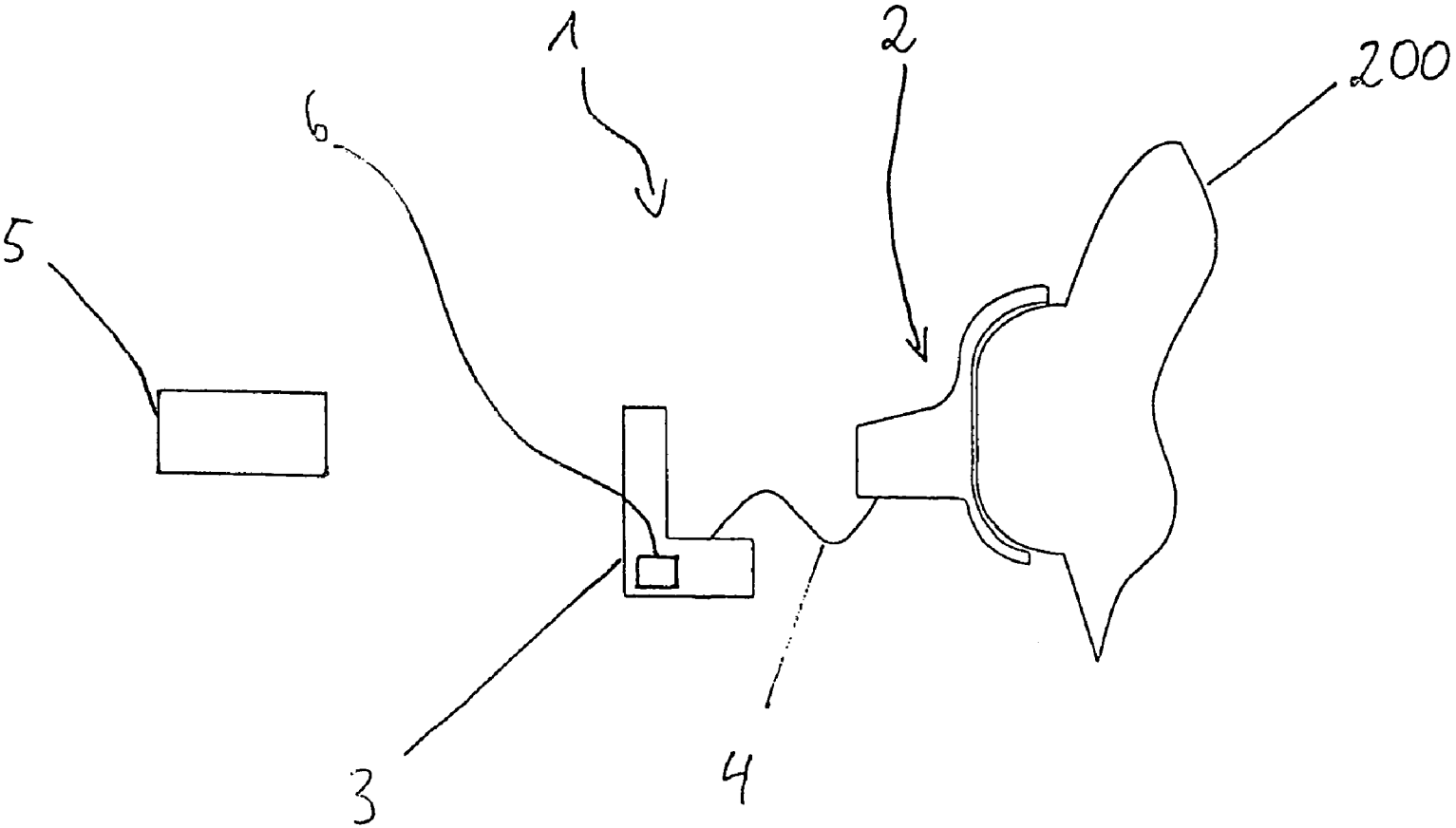

U.S. PATENT DOCUMENTS 5,754,108 A * 5/1998 Ungarsohn ..... 340/568.1
5,790,020 A 8/1998 Sasagawa et al.
5,910,768 A * 6/1999 Ott ..... 340/568.2
5,936,526 A * 8/1999 Klein ..... 340/571
5,955,948 A * 9/1999 Howell ..... 340/568.7
5,995,003 A * 11/1999 Rogers ..... 340/568.4
6,204,772 B1 * 3/2001 DeMay et al. ..... 340/686.1
6,362,736 B1 * 3/2002 Gehlot ..... 340/568.1
2001/0028295 A1 * 10/2001 Brinkmeyer et al. ..... 340/5.25

FOREIGN PATENT DOCUMENTS

DE 296 24 318 U1 4/1996
DE 197 11 571 A 10/1998

OTHER PUBLICATIONS

German Office Action dated Oct. 30, 2003.
German Translation Aid, Jul. 22, 2005.

* cited by examiner

METHODS AND DEVICES FOR PROTECTING AN ARTICLE AGAINST THEFT

The present invention relates to methods and devices for protecting commercial goods against theft pursuant to the preambles to the independent claims.

In shops or warehouses, it is customary to display the radios or television sets, video sets, telephones and so forth that are offered for sale. To accomplish this, frequently one display sample of each type of item is made available to customers for test purposes. To prevent any possible loss, these display samples are preferably equipped with devices that will trigger an alarm in the event of an attempted theft.

There are known devices for protecting commercial goods against theft that are equipped with a receiver, wherein the receiver is continuously in operation, so that the security component requires a high power input level, which is undesirable especially in battery-operated security devices.

Furthermore, known devices have the disadvantage that, for example, when multiple security units are operated using a single common central unit, a cumbersome selection of a specific security unit to be activated next is required, e.g., via corresponding input from an operator, before that particular security unit can be activated.

The object of the present invention is to create methods and devices for protecting commercial goods against theft, in which their operation and manipulation are simplified and their service life is extended.

This object is attained in the methods and devices of the type specified above pursuant to the invention through the characterizing portions of the independent claims.

The characterizing feature that the receiver is deactivated in the monitoring mode results in a reduction in the power consumed by the devices of the invention, thus extending the service life of the devices.

Furthermore, it is especially advantageous that a device of the invention cannot be influenced by any type of signals once its receiver has been deactivated in the monitoring mode. A disruption of a device as specified in the invention by an erroneous signal reception is thereby excluded. This increases the functional reliability of the device. As has already been mentioned, the amount of power consumed by the device specified in the invention in its monitoring mode is decreased by the deactivation of the receiver. Furthermore, the monitoring mode ordinarily is the mode the device is in the majority of the time. In the alarm mode the receiver is activated. However, the alarm mode is substantially shorter in duration than the monitoring mode. Therefore, the power consumption of the device of the invention is decreased. At the same time, the activation of the receiver in the alarm mode makes it possible for the device of the invention to be manipulated in this alarm mode by the operator via the receiver.

The device specified in the invention may, on one hand, be a security unit that is operated as a so-called "stand-alone security unit". This means that the security unit can be used essentially to protect only one single item, for example, a single mobile telephone, against theft. For each additional item, therefore, an additional corresponding security unit is required. The security units for the various commercial products thus operate independently of one another. In this case, the characterizing features of the invention refer to a single security unit of this type.

On the other hand, the device specified in the invention may involve a central unit to which multiple security units can be connected. In this case, each of the security units can be assigned to one commercial item, so that with this device of the invention, multiple commercial items can be monitored simultaneously. In this case, the characterizing features of the invention refer to the central unit.

In one advantageous further improvement of the invention, the alarm mode is terminated when the receiver receives a signal from a transmitter. This is possible, according to the invention, because the receiver is activated with the switch from the monitoring mode to the alarm mode. Thus, signals that are emitted by the transmitter can be received by those devices that are in the alarm mode, and therefore their receiver is activated. With these signals, also referred to as selection signals, the alarm mode can then be terminated and the device of the invention can again be properly attached to the commercial item, for example, following a theft attempt.

This represents an automatic selection of the device that is in the alarm mode. Thus, the operator need not select the device that is in the alarm mode in a cumbersome manner, e.g., with the corresponding proper input, rather the operator can terminate the alarm mode by merely actuating the transmitter. Because only the receiver of the device that is in the alarm mode is activated, only that device is affected. All other devices remain unaffected, which is synonymous with the above-mentioned automatic selection of the device that is in the alarm mode. Obviously this represents a substantial simplification of the operation of the device specified in the invention. The same applies when multiple devices as specified in the invention are in the alarm mode.

In a further advantageous improvement of the invention, the system is switched from an on-state mode to a connect mode when the receiver receives a signal from the transmitter. In the on-state mode, the receiver is also activated. In this manner, it is possible for the device of the invention to be switched by an operator to the connect mode, in which mode the device can then be prepared for switching to the monitoring mode.

This again represents an automatic selection process, in that only that device that was switched on beforehand and is thus in its on-state mode can be switched by the operator to the connect mode. All the other devices remain unaffected by the operator's actions.

Once the operator has switched the device of the invention to the connect mode, the operator can perform the necessary steps to prepare the device for the monitoring mode, in other words for ultimately switching it to "armed". This can be achieved, for example, by affixing a security unit to the item, which, if damaged or removed while in the monitoring mode, will cause the device to switch over to the alarm mode.

It is particularly advantageous for the device specified in the invention to switch to the alarm mode if the switch to the monitoring mode does not take place within a predetermined time interval. In this manner, it can be ensured that the device of the invention does not remain continuously in the connect mode, in which no monitoring for theft takes place. Such a condition could occur, for example, if an operator affixes a device of the invention to a commercial product, intending to switch it to "armed", but is interrupted in this task and forgets where he is in the process. An operator error of this type is reliably prevented with the device specified in the invention, which at the same time provides an enhancement of user friendliness and operating reliability.

According to one advantageous embodiment of the invention, a bracket component for the security unit is affixed to the commercial product, with a monitoring of the bracket component being activated upon proper attachment to the item. During this monitoring process, the device of the invention is continuously monitored to determine whether the bracket component is properly fastened to the commercial product. If the bracket component is fastened to the commercial item within the predetermined time interval, the monitoring mode is activated without the device being first shifted to an alarm. This represents the normal operating sequence for attaching a bracket component to the commercial product. If the bracket component is not affixed to the commercial product within the preset time interval, thus activating the monitoring mode, the device of the invention, as mentioned above, is switched to an alarm. As was already mentioned, this facilitates the recognition of bracket components that are not properly affixed to the commercial products.

According to a further embodiment of the method specified in the invention, it is particularly advantageous for an encoded selection signal to be used, in order to render a misuse more difficult. For example, when multiple transmitters are used, each of the transmitters can be provided with a different encoded selection signal.

Furthermore, it is possible to form groups of devices of the invention, each of which is allocated to the same transmitter. Groups of this type may involve a group of common "stand-alone security units", or a group of common central units, wherein in the latter case, multiple security units can be connected to each of the central units, as mentioned above. It is particularly expedient, for example, to form the groups of devices of the invention based upon spatial unity. For example, it is possible to use the same transmitter to control all the devices that are arranged in a certain store aisle or department for the protection of the items stored therein. In this case all the devices can be controlled simultaneously, as long as all the devices are within range of the transmitter.

According to a further advantageous embodiment of the invention, the device of the invention will not terminate the alarm mode if a selection signal that is received during the alarm differs from the selection signal that is received after it has been switched on. In this manner it is ensured that in order to terminate the alarm mode for a device, the same transmitter and/or the same selection signal must be used as was used after the device was switched on.

The device specified in the invention can preferably be switched off by switching off a power source to the security unit. When the device is switched off, any selection signal that was received beforehand, i.e., after the device was switched on, is lost, because the selection signal is stored in the receiver of the device in a volatile memory, for example, in so-called random access memory (RAM). In this manner a new selection signal can be transmitted to the device of the invention when it is switched on again, which is then again stored in the volatile memory, until the device is switched off again.

To facilitate operation, the invention provides for a selection signal to be transmitted from a transmitter to at least one other transmitter so that selection signals, including encoded selection signals, can be duplicated and sent to several transmitters. This creates the option, for example, of having various operators simultaneously controlling a certain group of devices of the invention.

To further simplify the operation of the device of the invention, another embodiment proposes that one or more operating modes of the device be indicated via an optical and/or acoustic signal. According to the invention, optical and/or acoustic signal generators can be used to accomplish this, and are housed in the security unit and/or in the central unit. Light-emitting diodes as optical signal generators and piezoelectric sound generators as acoustic signal generators are particularly favorable due to their low power input. These signal generators are used in the invention, for example, to indicate an alarm mode and thereby an alarm.

One advantageous embodiment of the invention provides that the signal generators are arranged inside the device of the invention, wherein a housing is at least partially translucent or transparent, so that the optical signal generated by the light-emitting diode can also be easily recognized outside of the security unit and/or the central unit. In this connection, it is particularly advantageous for the device to comprise a translucent housing or translucent housing sections, as the effectiveness of the optical signal is further increased by scattering effects on the translucent housing sections, which customarily are made of plastic.

A further advantageous embodiment of the method of the invention provides that the remaining time modulates the optical and/or acoustic signal, namely the signal is modulated based upon the remaining time interval, e.g., for example, its intensity or frequency is altered. A modulation of this type allows an operator to easily estimate the amount of time that remains and especially to adjust the process sequence in the configuration of the device of the invention to correspond with the amount of time that remains.

A particularly simple operation of the device specified in the invention is provided with a further variation, in which the selection signal is transmitted from the transmitter to the receiver by means of a remote operation system. In principle, it is possible to employ optical remote operation systems, in other words, e.g., infrared-based remote operation systems. Radio-remote operation systems, however, permit an even simpler operation of the invention, as a direct sight connection between the transmitter of the radio control operation and the receiver that is housed inside the device of the invention is not necessary.

Another advantageous embodiment of the method of the invention provides that the status of the energy supply to the device of the invention is monitored. For assessing the status of the energy supply in the operation of the device, it is especially helpful for acoustic and/or optical signals to be generated based upon the status of the energy supply.

In order to simultaneously allow the actuation of one or more different groups of devices of the invention, to each of which different selection signals are allocated, using a single remote operating system, a further advantageous embodiment of the invention provides that the transmitter may optionally transmit one of several preset selection signals, which in turn can be encoded. An operator can choose the desired selection signal, for example, via a switch located in the remote operating system.

A further variation of the invention provides that in attaching a bracket component to the commercial product and/or in attaching a mounting component at a mounting point that preferably is protected against theft, the monitoring is activated in that a measuring loop formed by sensors in the bracket component and/or in the mounting component is closed.

According to a further advantageous embodiment of the present invention, if an attempt is made to separate the bracket component from the commercial product or the mounting component from the mounting point or the bracket component from the mounting component or the security unit from the central unit, especially by severing the connector, the measuring loop is opened.

In a particularly advantageous embodiment of the present invention, the measuring loop of the bracket component and the measuring loop of the mounting component are connected in series. According to the invention, the sensors are designed as electrical or optical sensors, wherein ohmic sensors, for example, in the form of foil-type conductor loops, are particularly advantageous.

It is also highly advantageous for the bracket component and/or the mounting component to be equipped with an adhesive layer for fastening the bracket component to the commercial product or for affixing the mounting component to the mounting point. The double-sided adhesive strip sold by the Beiersdorf firm under the trade name "Tesa power strip" has proven particularly well suited in practice for the above-named purposes. It is also conceivable to use other double-sided adhesive strips or similar products.

To ensure the reliable recognition of a theft attempt, it is necessary for the adhesive layer to adhere more strongly to the product or to the mounting point than to the bracket component or to the mounting component. Only then can it be ensured that in a theft attempt one of the measuring loops or both measuring loops will be interrupted.

For more simple operation, in a further advantageous embodiment of the invention, it is provided that the adhesive layer(s) are equipped with a grip tab. The adhesive layer can be grasped by this grip tab, allowing it to be easily removed from the product or from the bracket component and/or the mounting point or even the mounting component. To this end, it is highly advantageous for the double-sided adhesive strip to be removable from the product without leaving any residue. In this case, it is also possible for the adhesive strip to be reused.

According to a further advantageous embodiment of the device specified in the invention, the sensors can be at least partially integrated into the adhesive layer, so that the installation space that is required for the sensors is reduced. For example, part of a measuring loop can be arranged directly on the adhesive layer, e.g., in the form of an electrically conductive graphite layer or a foil-type conductor arrangement.

Another advantageous embodiment of the invention provides for the receiver to be located in the device specified in the invention, specifically in the mounting component or in the central unit. Furthermore, it is expedient for the mounting component to be equipped with a battery compartment, so that a power source for the security unit, e.g., in the form of a battery, can be housed directly in the security unit.

A further advantageous embodiment of the device specified in the invention proposes that the bracket component be equipped with a first mounting point and a—preferably flat—second mounting point, with the second mounting point being designed to be more flexible than the first mounting point. This makes it possible for the bracket component at the second mounting point to be adjusted very easily to fit the commercial product to be protected, especially to fit round shapes. The increased flexibility of the second mounting point relative to the first mounting point can be achieved, for example, by selecting a material thickness for the bracket component at the second mounting point that is thinner than the material thickness of the bracket component at the first mounting point. The material thickness at the first point should be great enough to enable a stable mounting of the bracket component on the security unit.

To affix the bracket component to the mounting component, for example, a combined suspension and/or latching device and/or a coupling via a magnet is conceivable, which will enable a separable connection. In this manner, an attractive display of a product that is fastened to the bracket component is possible. If a customer wishes to examine the product more closely, the bracket component can be unlatched or taken down or removed from the mounting component. Most advantageously, the connectors used for this purpose are designed to be cable, especially flat ribbon cable.

In order that the cable used in attaching the product or the bracket component to the mounting component does not hang down into a display area of the product aisle, a retractor device for the cable is provided in the security unit, which can be used to retract the cable into the security unit when it is not in use.

Further characterizing features, possible applications, and advantages of the invention are found in the following description of exemplary embodiments of the invention, which are represented in the figures of the drawing. In this, all described or presented characterizing features, alone or in any combination, form the object of the invention, independent of their integration in the patent claims or their reference, and independent of their formulation or presentation in the description or in the drawings.

Figure 2:
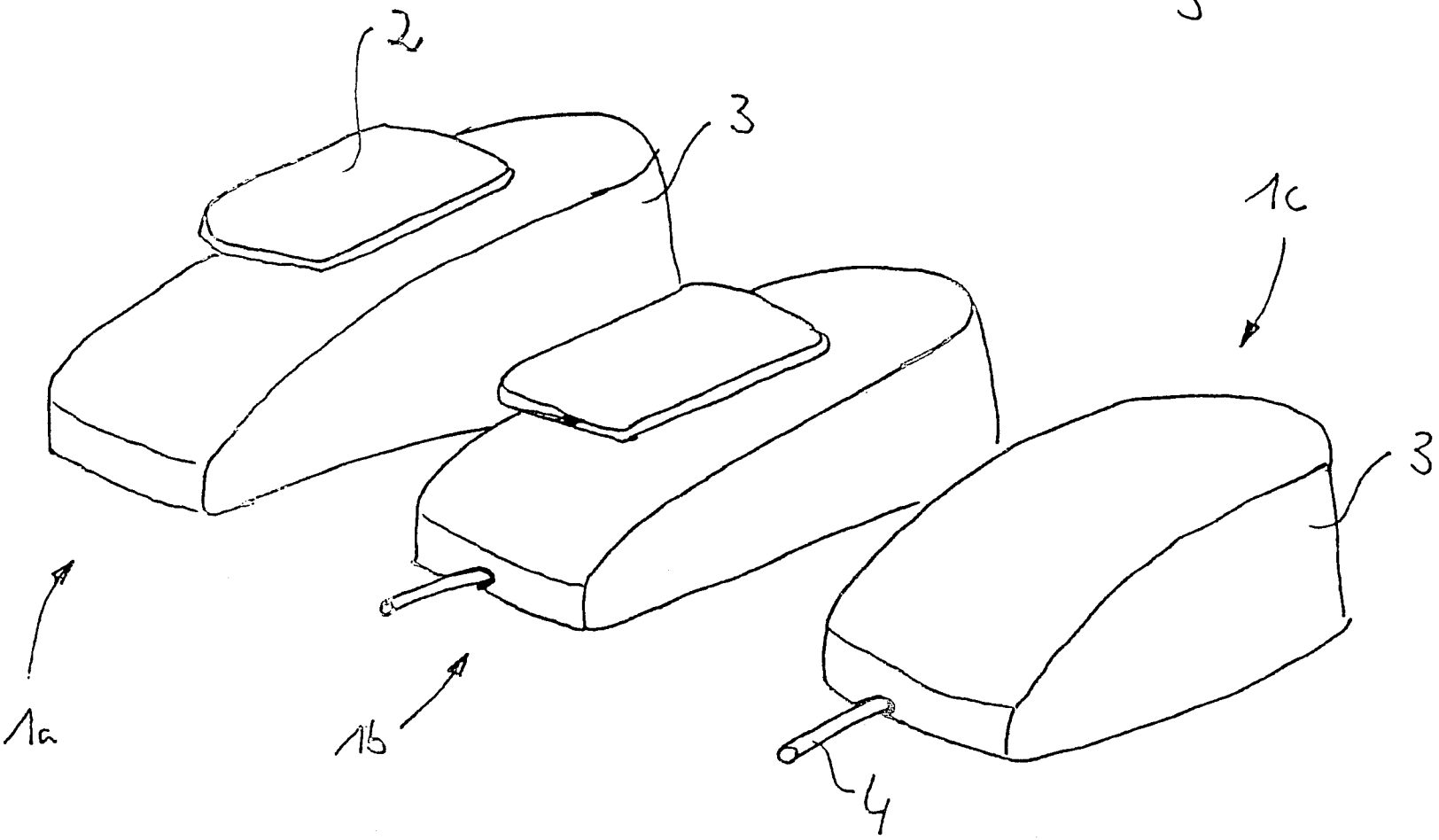
Figure 3A:
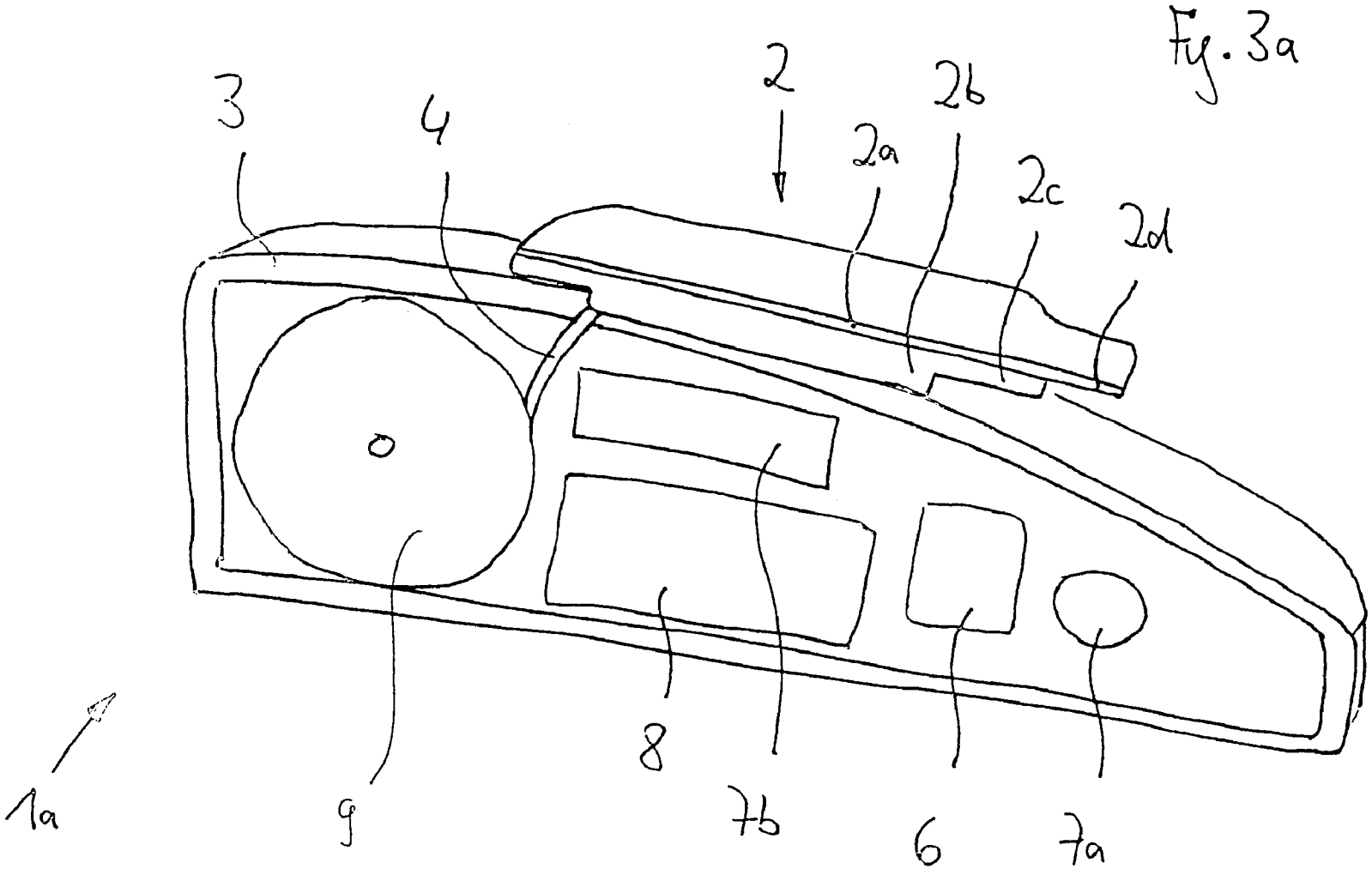
Figure 3B:
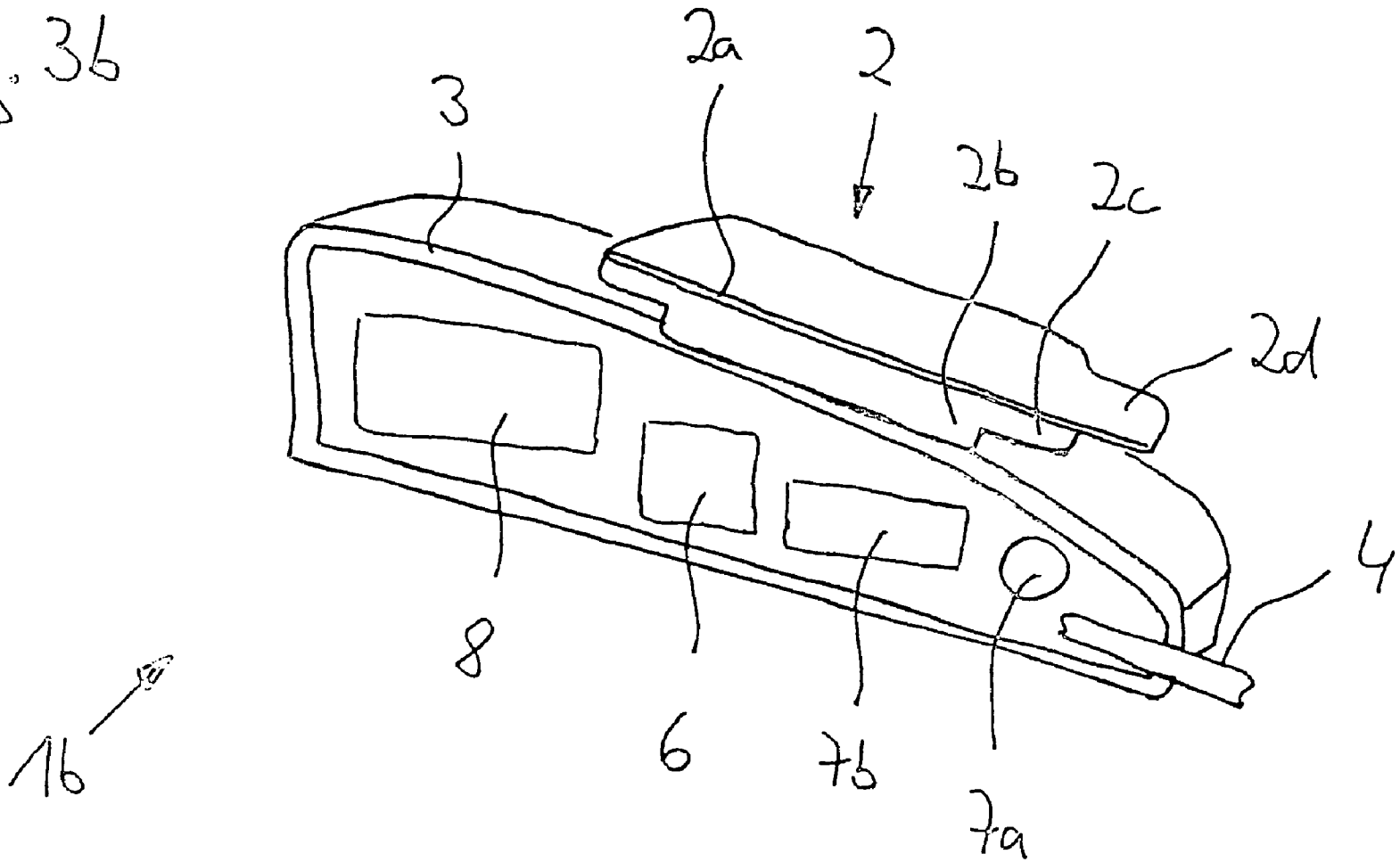
Figure 3C:
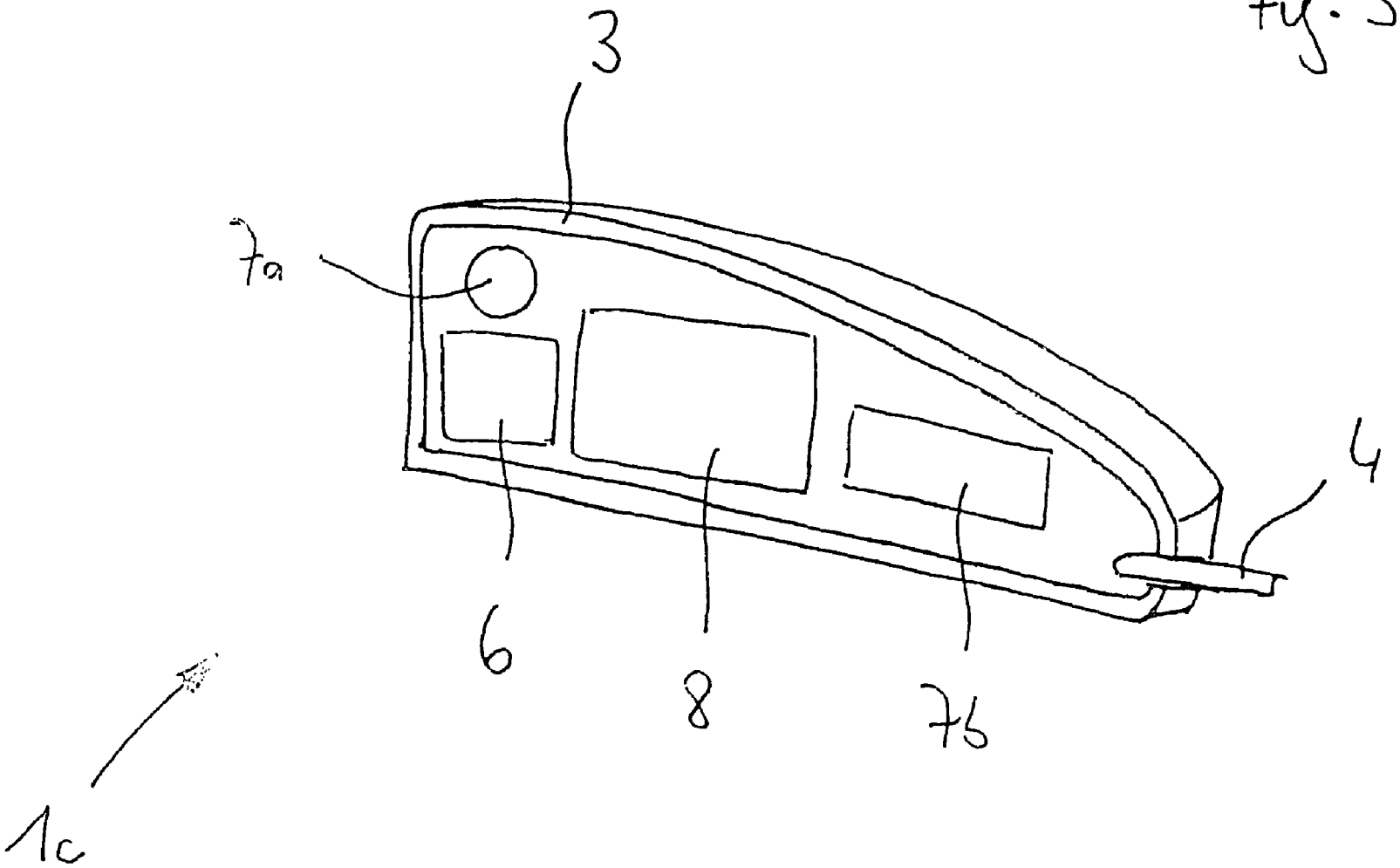
Figure 4:
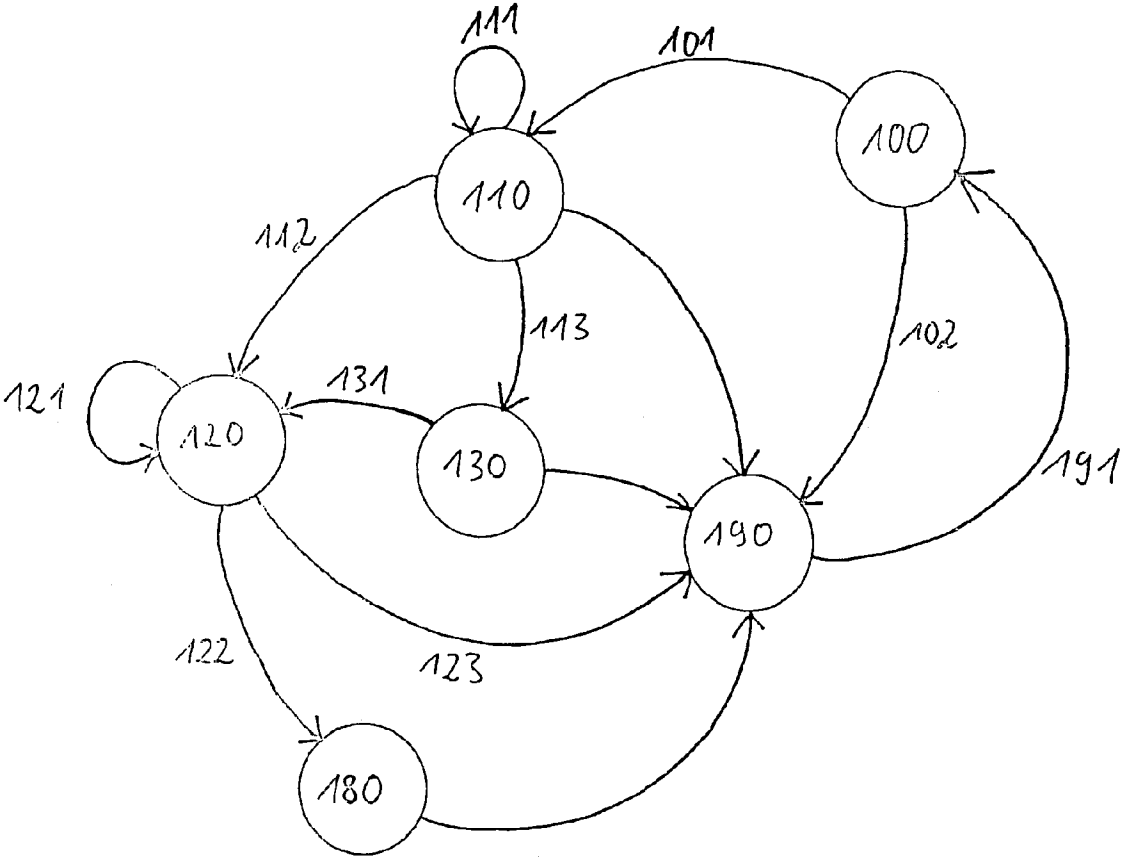
Figure 5:
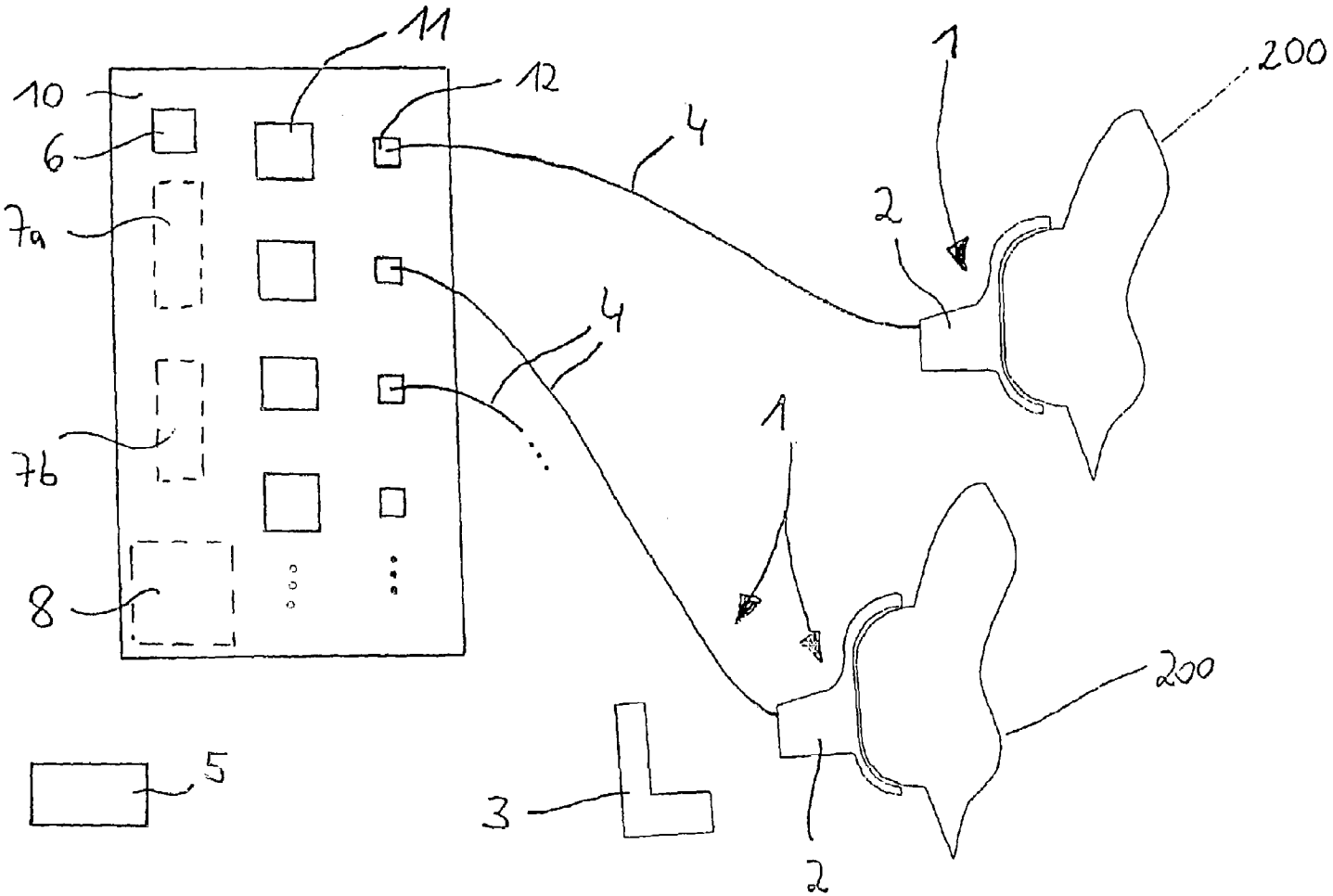

FIG. 1 shows a schematic illustration of a first embodiment of a security unit 1 as specified in the invention, FIG. 2 shows three different embodiments 1*a*, 1*b*, 1*c* of the security unit 1 as specified in the invention, FIG. 3*a* shows an enlarged elevation in a partial cross-section of the security unit 1*a* from FIG. 2, FIG. 3*b* shows an enlarged elevation in a partial cross-section of the security unit 1*b* from FIG. 2, FIG. 3*c* shows an enlarged elevation in a partial cross-section of the security unit 1*c* from FIG. 2, FIG. 4 shows a section from a state diagram that depicts one embodiment of the security method specified in the invention, and FIG. 5 shows a schematic view of another possible application of the invention with a central unit.

The security unit 1 of the invention illustrated schematically in FIG. 1 serves to protect products especially against theft. The security unit 1 comprises a bracket component 2 and a mounting component 3. The bracket component 2 is attached to the mounting component 3 via connectors 4. In the mounting component 3, a receiver 6 is located, which can be impinged upon by an operator using a transmitter 5.

The mounting component 3 is used to attach the security unit 1 to a mounting point, preferably embodied by an object that cannot be stolen (not shown here), for example, a product aisle shelf or some similar construction.

To this end, the mounting component 3 is equipped with an adhesive layer, not shown here, which is formed by a double-sided adhesive strip. The double-sided adhesive strip preferably is the double-sided adhesive strip sold by the Beiersdorf firm under the trade name "Tesa power strip".

Integrated into the adhesive layer is a measuring loop, also not shown here, which is equipped with a foil-type conductor arrangement. This measuring loop is interrupted if the mounting component 3 becomes separated from the mounting point, e.g., during a theft attempt.

A sensor element with an adhesive layer of this type is described in detail in the German Utility Model DE 202 13 672.8.

It is possible to equip the mounting component 3 with the adhesive layer used to attach it to the mounting point already during its manufacture. To accomplish this, one side of the double-sided adhesive strip that forms the adhesive layer is oriented on and attached to the mounting component 3 in such a way that two or more contact points of the measuring loop that is provided in the adhesive layer are in contact with corresponding contact points on the mounting component, so that the measuring loop of the mounting component is closed.

In one variation of the adhesive layer, the measuring loop is formed by a surface section of the adhesive layer that is coated with graphite, which connects the contact points of the mounting component with one another (see DE 202 13 672.8). In this variation, it is particularly advantageous for the adhesive layer to adhere more strongly to the mounting point than to the mounting component 3, so that when an attempt is made to remove the mounting component 3 from the mounting point, the measuring loop is reliably interrupted, triggering an alarm.

With the above-described measures, a secure connection of the mounting component 3 to the mounting point, which can then be monitored by means of the measuring loop for proper attachment, can be realized.

In the same manner, the bracket component 2 that can be connected to the mounting component 3 via the connectors 4 can be attached to a product 200. The adhesive layer 2*a* used for this purpose (see FIG. 3*a*) also advantageously comprises a "Tesa power strip", which contains a measuring loop or at least portions thereof, connecting corresponding contact points (not shown here) in the bracket component 2 with one another, thereby closing the measuring loop of the bracket component 2 when the adhesive layer 2*a* is properly and correctly oriented and attached to the bracket component 2. With the adhesive layer 2*a* of the bracket component 2, for the reasons stated above, it is also expedient for the adhesive layer 2*a* to adhere more strongly to the product 200 than to the bracket component 2. Here again, please refer to the German Utility Model DE 202 13 672.8.

In one variation of the invention, the measuring loops of the mounting component 3 and the bracket component 2 are connected in series. An electrical connection of the two measuring loops, or the measuring loop of the bracket component 2 to the mounting component 3, is ensured by the connector 4, which is designed as a flat ribbon cable. Either the interruption of one of the measuring loops or of both measuring loops, or a severing of the flat ribbon cable will then trigger an alarm.

As is apparent from FIG. 3*a*, the bracket component 2 of the security unit 1*a* in one embodiment of the invention comprises a first mounting point 2*b* and a second mounting area 2*c* that is designed as a flat surface. Due to its relatively great material thickness, the first mounting point 2*b* has a high level of firmness, which permits a secure fastening of the bracket component 2 to the mounting component 3, for example, via a combined suspension and/or latching mechanism and/or a magnetic coupling.

The second mounting area 2*c* of the bracket component 2 has a lower material thickness and as a result is flexible and can be elastically shaped, so that the bracket component 2 can be optimally adjusted, especially at the second mounting area 2*c*, even to round surfaces of the product 200 (FIG. 1), in order to maximize a contact surface that can be equipped with the adhesive layer 2*a* between the bracket component 2 and the product 200.

As can be seen in FIG. 2, the security unit 1*a* (see also FIG. 3*a*), in contrast to the other security units 1*b* and 1*c*, has no connectors 4 that are visible from the outside in the condition shown here.

In FIG. 3*a*, it is apparent that the security unit 1*a* is equipped with a retractor device 9 that is arranged in the mounting component 3, which is loaded by a torsion spring (not shown here) and makes it possible to retract the flat ribbon cable 4 into the security unit 1*a*, so that the flat ribbon cable 4 does not dangle around freely while the bracket component 2 is held by the suspension and latch mechanism or by the magnet in or on the mounting component 3.

Further, the security unit 1*a* is equipped with a battery compartment 8 designed to hold a battery, which is used as the energy source for the security unit 1*a*. In addition to the battery compartment 8, a light-emitting diode 7*a* and a piezoelectric transducer 7*b* are provided in the security unit 1*a*, which emit optical and/or acoustic alarm signals when an attempted theft is recognized.

In addition to emitting alarm signals, a certain series of flashes from the light-emitting diode 7*a* signals a worsening of the load condition of the battery (not shown here), which is continuously monitored in the operation of the security unit 1*a*, so that an operator will be informed as to the imminent necessity of a battery change in the security unit 1*a*.

A particularly high signal effectiveness of the optical signals emitted by the light-emitting diode 7*a* can be achieved by designing the housing of the mounting component 3 to be at least partially translucent, so that the light that emanates from the light-emitting diode 7*a* housed inside the mounting component 3 is scattered by the translucent areas of the housing.

The adhesive layer 2*a* of the bracket component 2 is equipped with a grip tab 2*d*, by which the adhesive layer 2*a* can be grasped, for example, so that it can be pulled off of the bracket component 2 or the product 200 (FIG. 1) by an operator. The adhesive layer 2*a* can be separated without residue and without damage to the associated adhesive surfaces. The adhesive layer of the mounting component 3 (not shown here), which can be applied in the case of the security unit 1*a*, for example, in the lower area of the mounting component 3, also is equipped with a grip tab.

With reference to the constitution diagram in FIG. 4, the security method specified in the invention will be described below.

Once an operator has inserted a battery into the battery compartment 8 (FIG. 3*a*), the security unit 1 is placed in an on-state mode 100 (see FIG. 4). In this on-state mode 100, at least the receiver 6 (FIG. 1) of the security unit 1 is activated.

Subsequently, the operator will send out a selection signal using the transmitter 5, shown in FIG. 1 and designed, for example, as a radio remote operating system, sending it from the transmitter 5 to the receiver 6, which is housed in the mounting component 3 of the security unit 1 (FIGS. 1 and 3*a*).

The transmission of the selection signal is indicated by the number 101 in FIG. 4 and shifts the security unit 1 to a connect mode 110. At the same time, the receiver 6 stores the selection signal transmitted by the transmitter 5 in a memory, whereby the security unit 1 is assigned either to the transmitter 5 or to its selection signal. Furthermore, the receiver 6 of the security unit 1 is deactivated in the stage 111, specifically it is switched off, so that the amount of power consumed by the security unit 1 is decreased relative to the on-state mode 100. The deactivated state can, for example, be a so-called sleep mode, in which only certain components of the receiver 6 remain switched on, while the majority of components are switched off.

Once the security unit 1 has entered the connect mode 110, an operator must attach the bracket component 2 of the security unit 1 to the product 200 and the mounting component 3 to the mounting point. In this manner, the measuring loops located in the adhesive layers of the bracket component 2 and of the mounting component 3 are closed, and the security unit 1 switches through the mode transition 113 to a monitoring mode 130.

If the adhesive layers have already been applied beforehand to the security unit 1, for example, during manufacture of the security unit 1, the security unit 1 switches from the connect mode 110 directly to the monitoring mode 130, which also is reached via the mode transition 113.

It is also possible for the security unit 1 to shift from the connect mode 110 directly to an alarm mode 120 in the stage 112. This is the case when, after the connect mode 110 has been reached, the measuring loops are not closed within a preset time interval. This serves to prevent the security unit 1 from being switched by the operator to the on-state mode 100 and then to the connect mode 110, but due to some operator oversight the measuring loops are not closed, so that the mode transition 113 into the monitoring mode 130 does not take place, and thereby no monitoring of the product 200 takes place.

During the remaining time interval before the security unit 1 shifts to the alarm mode 120, the remaining time interval modulates an operating signal from the light-emitting diode 7*a* and/or the piezoelectric transducer 7*b*, so that an operator can estimate how much time remains before the security unit 1 will switch to the alarm mode 120. The modulation comprises, for example, a change in the intensity or the frequency of the operating signal.

It is also possible for the connect mode 110 to be indicated, e.g., by a distinct, constant series of flashes from the light-emitting diode 7*a*.

Via the stage 131, the security unit 1 can shift from the monitoring mode 130 to the alarm mode 120. This is ordinarily the case when one of the measuring loops or even both measuring loops are opened within the framework of an attempted theft, or if the connector 4, for example, the flat ribbon cable, is severed.

The security unit 1 will remain in the alarm mode 120, although future changes from the alarm mode to other modes are possible. In this mode, specifically immediately after the shift to the alarm mode 120, the receiver 6 of the security unit 1 is activated, as is indicated in stage 121 (see FIG. 4), so that in the alarm mode 120 the security unit 1 is ready to receive. Further, in the alarm mode 120 an optical and/or acoustic alarm is emitted via the light-emitting diode 7*a* and/or the piezoelectric transducer 7*b*.

A first possibility for terminating the alarm mode 120 is for the operator to use the transmitter 5 (FIG. 1) to retransmit the same selection signal to the receiver 6 of the security unit 1 with which the security unit 1 was switched from the already described on-state mode 100 to the connect mode 110. This selection signal is stored in the receiver 6—as described above.

Once the stored selection signal has been received by the receiver in the alarm mode 120, the security unit 1 shifts to a further mode 180, as indicated by the number 122 (FIG. 4), which is not described in greater detail and represents further possible operating modes for the security unit 1 in FIG. 4. In the mode 180, the alarm is no longer activated. From the mode 180, a transition to a disconnect mode 190 is possible. Further mode transitions from the mode 180 to the other operating modes are not represented in FIG. 4. The listed operating modes can, for example, represent other functions of the security unit 1 and will not be described at present, as they are not of importance to the security method of the invention.

If the selection signal that is received by the receiver 6 of the security unit 1 in the alarm mode 120 does not coincide with the selection signal that was previously received in the on-state mode 100, the security unit 1 will remain in the alarm mode 120. Thus, only an operator who has the transmitter 5 with the correct selection signal can terminate the alarm mode 120. An unintentional or even invalid termination of the alarm mode 120 by a third party is thereby prevented.

A second possibility for terminating the alarm mode 120 consists in removing the energy source from the security unit 1 in the stage 123, so that the security unit 1 shifts to the disconnect mode 190. In the disconnect mode 190, the alarm is not longer activated.

In order to ensure a reliable monitoring of the product 200, the security unit 1 is designed such that it is not possible to remove the energy source for the security unit 1 without triggering an alarm, for example, by interrupting the measuring loops of the security unit 1. In this manner, it can be ensured that an invalid removal of the energy source of the security unit 1, for example, in a theft attempt, will inevitably trigger an alarm.

In principle, the security unit 1 can be shifted from each of the described modes 100, 110, 120, 130, 180 to the disconnect mode 190 by removing the energy source. From the disconnect mode 190, the security unit 1 can again be switched to the on-state mode 100 by switching on 191 the energy source.

It is particularly expedient for the security unit 1 to be shifted, for example, in the stage 102 first to the disconnect mode 190 and afterward via the stage 191 to the on-state mode 100. In this manner, the selection signal that has been stored in the memory of the security unit 1 is erased, so that the security unit 1 can receive a new selection signal from a transmitter and can store it. Upon reaching the disconnect mode 190, the previously received selection signal is purged, because it is stored in a volatile memory in the receiver, the memory content of which is retained only with a continuous energy supply. In this manner, a different selection signal can very easily be assigned to the security unit 1.

Very generally, it is also possible for the transmitter 5 to transmit an encoded selection signal in order to impede a misuse of the device of the invention. However, in order to be able to provide additional transmitters 5 with the same selection signal, it is possible with one embodiment of the invention to transmit a selection signal from one transmitter 5 to another transmitter 5.

One major advantage of the invention is that the receiver 6 of the security unit 1 is deactivated upon reaching 101 the connect mode 110 in the stage 111. This can preferably be a sleep mode. In this manner, the amount of power consumed by the security unit 1 is reduced and the battery or power source is conserved.

The deactivation 111 of the receiver 6 specified in the invention provides a further significant advantage, which is particularly important when a single transmitter 5 is used with multiple security units 1.

First, as with the operation using only one security unit 1, it is possible to assign multiple security units 1 as a group to the transmitter 5, which can be accomplished for all security units 1 simultaneously by transmitting the selection signal from the transmitter 5, as long as all the security units 1 are located within the receiving range of the transmitter 5. Afterward, all security units 1 can be shifted to the monitoring mode 130 (FIG. 4).

When one of the multiple security units 1 shifts from the monitoring mode 130 to the alarm mode 120 as a result of a theft attempt, its receiver 6 is activated (stage 121), and the security unit 1 that is in the alarm mode 120 can be switched to the subsequent mode 180 by a retransmission of the selection signal via the transmitter 5, in order to shut down the alarm. In this it is highly advantageous for only the receiver 6 of the security unit 1 that is affected by the theft attempt to be active, while the receivers 6 of the security units 1 that are still in the monitoring mode 130 remain deactivated. In this manner the necessity is eliminated, known with conventional security devices, of first identifying and selecting the security unit 1 that is in the alarm mode 120 before it can be shifted to the mode 180 by retransmitting the selection signal. The selection of the security unit 1 that is affected by the attempted theft from the multitude of security units 1 is accomplished practically automatically and/or implicitly in that only its receiver 6 is activated, i.e., is ready to receive.

The above-described retransmission of the selection signal does not affect the remaining security units 1 that are still in the monitoring mode 130. Thus, a very simple operation of multiple security units 1 with only a single transmitter 5 or with a single selection signal is ensured.

Rather than shifting to the mode 180, it is also possible for one of the security units 1 to be shifted directly to the connect mode 110 or back to the monitoring mode 130 by again receiving the selection signal to terminate the alarm mode 120.

For a single security unit 1 the following can be summarized:

After the security unit 1 has been placed in the on-state mode 100, a specific selection signal is transmitted by the transmitter 5 to the receiver 6 housed in the security unit 1, in order to assign the security unit 1 to the transmitter 5, and to switch the security unit 1 to the connect mode 110. The receiver 6 is then deactivated in the connect mode 110.

With the deactivation 111 of the receiver 6, the power consumption of the security unit 1 is decreased. Furthermore, the deactivation 111 prevents the security unit 1 from unintentionally receiving other selection signals.

Once the security unit 1 has been switched to the alarm mode 120, for example, as a result of an attempted theft, the receiver 6 of the security unit 1 is reactivated, in order to again permit the reception of the specific selection signal. With a selection signal of this type, the alarm mode 120 can then be terminated.

The same also applies to a group of security units 1, to one or more security units 1 that are connected to the central unit 10 (FIG. 5), and to a group of central units 10 of this type.

Although the above description of the security method of the invention refers to the security unit 1, the statements also apply to the embodiments 1*a*, 1*b*, and 1*c*, represented in FIG. 2, of the security unit 1 of the invention.

From FIG. 3*b* it is obvious that the security unit 1*b* is not equipped with a retractor device 9 (see FIG. 3*a*) for the flat ribbon cable 4. Rather, the housing of the mounting component 3 of the security unit 1*b* is equipped with an opening for the connectors 4, designed as flat ribbon cable, which connect the mounting component 3 to the bracket component 2. The further design of the security unit 1*b* is identical to the design of the security unit 1*a*.

In particular, each of the security units 1*a* and 1*b* is equipped on its mounting component 3 with a suspension and/or latching device and/or a coupling that incorporates a magnet, not described in any greater detail, for the purpose of mounting or fastening the bracket component 2, in or on which the bracket component 2 can be suspended or affixed for display and storage purposes. This circumstance is indicated in that each of the security units 1*a* and 1*b* in FIG. 2 is represented with a suspended bracket component 2.

The security unit 1*c* is not equipped with a suspension or latching device for holding the bracket component. Nevertheless, it is equipped with a bracket component, which is not illustrated here. The bracket component of the security unit 1*c* (FIG. 3*c*) is connected to the mounting component 3 of the security unit 1*c* via the connector 4 that is designed as a flat ribbon cable. Because the bracket component of the security unit 1*c* cannot be suspended in the mounting component 3, it is particularly well suited for protecting large products 200, which due to their weight or their dimensions cannot be suspended via the bracket component on the mounting component 3 anyway, rather, e.g., they must be stored on an aisle shelf.

Depending upon the variation 1*a*, 1*b*, 1*c* of the security unit 1, the internal design varies primarily in terms of the mounting components, wherein, however, with each of the security units 1*a*, 1*b*, 1*c* a translucent housing is provided in order to increase the signal effectiveness of an optical signal emitted by the light-emitting diode 7*a*, along with sound emission openings in the area of the piezoelectric transducer 7*b*.

A further possible application for the invention is represented in FIG. 5. There multiple security units 1 are present, each of which comprises at least one bracket component 2 and if necessary also one mounting component 3. With the bracket component 2, the product 200 to be protected is attached in the manner described via a correspondingly designed, double-sided adhesive strip (see German Utility Model DE 202 13 672.8).

In contrast, for example, to FIG. 1, the bracket components 2 of FIG. 5, however, are not attached via connectors 4 to their associated mounting component, rather connecting cables 4 are provided, via which each of the bracket components 2 is connected to a central unit 10. The result is that—as indicated above—one mounting component 3 need not necessarily be assigned to each bracket component 2, rather one bracket component 2 may also be provided without an associated mounting component 3. The further result is that the mounting component 3—assuming one is present—serves only for mounting the bracket component 2, and not for accommodating components for alarm recognition and/or alarm triggering.

The central unit 10 comprises a multitude of receptacles 12, into which the connector cable 4 from the bracket components 2 can be plugged using corresponding (not illustrated here) plugs. Each receptacle 12 represents one channel of the central unit 10. Further, the central unit 10 is equipped with display means, especially light-emitting diodes 11, wherein a separate light-emitting diode 11 is assigned to each channel of the central unit 10. The components assigned to the individual channels of the central unit 10 correspond to the number of channels present.

The central unit 10 includes a single receiver 6, optical and/or acoustic alarm devices 7*a*, 7*b* and a battery 8. These components correspond, for example, to the components of FIG. 1 having the same names. Furthermore, according to FIG. 5 a transmitter is present, which corresponds to the transmitter 5 of FIG. 1.

The security method of the invention pursuant to FIG. 4 can now also be applied as follows to the arrangement depicted in FIG. 5.

By inserting the battery 8 into the central unit 10 the on-state mode 100 is reached. The receiver 6 in the central unit 10 is activated. By transmitting the selection signal from the transmitter 5 to the receiver 6, the central unit 10 is shifted to the connect mode 110. The receiver 6 of the central unit 6 [sic] is deactivated (stage 111). In the connect mode 110, the multiple security units 1 can be connected to the central unit 10 via the connecting lines 4. For this—as was already described—a maximum time interval can be preset, within which at least one channel of the central unit 10 must be connected to a security unit 1. Afterward the central unit 10 is shifted to the monitoring mode 130. Alternatively, it is possible for the security unit 1 to be plugged beforehand into the central unit 10, so that the central unit 10 switches immediately to the monitoring mode 130. Now if one of the products 200 to be protected is separated from the corresponding bracket component 2, or if one of the connecting cables 4 is severed, or if one of the connecting cables 4 is pulled out of the central unit 10, this will result in a shifting of the central unit 10 to the alarm mode 120. In the alarm mode 120, an alarm is issued via the optical and/or acoustic alarm system 7*a*, 7*b*. In the alarm mode 120, the receiver 6 of the central unit 10 is activated, so that the alarm can be switched off via a retransmission of the selection signal from the transmitter 5 to the receiver 6, and the system can be shifted to the mode 180.

In contrast to the security unit 1 of FIG. 1, for example, in FIG. 5 the entire security method of FIG. 4 is based upon the central unit 10. Thus, the issuance of the alarm in the alarm mode 120 in FIG. 5 relates to the central unit 10, rather than to a specific security unit among the multiple security units 1 that are connected to the central unit 10. Which of the security units 1 that are connected to the central unit 10 has actually triggered the alarm is indicated only by the light-emitting diodes 11 that are assigned to the individual channels. For this purpose, in the central unit 10 a further switch or similar construct is contained, which is used to switch on the proper light-emitting diode 11 in whose allocated security unit 1 an alarm-triggering process (removal of the product 200 from the bracket component and/or severing of the connecting cable 4) has taken place, in order to indicate an alarm.

The arrangement depicted in FIG. 5 can preferably be used when multiple central units 10 are used, to each of which multiple security units 1 are connected. The multiple central units 10 can be used by different operators via different selection signals. In this, several central units 10 as a group can be assigned to a single operator. If an alarm is triggered by one of the multiple security units 1, then only the operator who is actually responsible for the associated central unit 10 to which the alarm-triggering security unit 1 is connected can terminate the alarm. The operator can then use the light-emitting diodes 11 to determine precisely which security unit 1 of those connected to the central unit 10 triggered the alarm.

The invention claimed is:

1. Method for protecting a commercial product against theft, in which a security unit has a monitoring mode in which theft protection is active such that a theft attempt will cause the security unit to switch to an alarm mode in which at least one of an acoustic and optical alarm is activated, the method comprising:

deactivating, in the monitoring mode, a receiver housed in the security unit outside of the commercial product; and activating the receiver when the security unit is shifted to the alarm mode, wherein the security unit has an on-state mode in which the receiver is activated and wherein the security unit is shifted from the on-state mode to a connect mode in which theft protection is not active when the receiver receives a signal from the transmitter, wherein, in the connect mode, the security unit is prepared for a shift to the monitoring mode, and wherein the security unit is shifted from the connect mode to the alarm mode if the security unit is not prepared within a preset time interval for a shift to the monitoring mode.

2. Method pursuant to claim 1, wherein the alarm mode is terminated when the receiver receives a signal from a transmitter.

3. Method pursuant to claim 1, wherein the receiver is deactivated when the security unit shifts to the connect mode.

4. Method pursuant to claim 1, wherein the security unit is placed in the on-state mode when the security unit is switched on.

5. Method pursuant to claim 1, wherein the security unit is equipped with a bracket component for mounting on the product, and wherein, in attaching the bracket component to the product, monitoring of the bracket component for proper attachment to the product is activated.

6. Method pursuant to claim 5, wherein the security unit is equipped with a mounting component that is connected to the bracket component via connectors, for fastening to a mounting point, and wherein, in attaching the mounting component to the mounting point, a monitoring of the mounting component for proper fastening to the mounting point is activated.

7. Method pursuant to claim 5, wherein, in at least one of attaching the bracket component to the product and attaching the mounting component to a mounting point, the monitoring is activated, wherein in at least one of the bracket component and the mounting component, a measuring loop that comprises at least one sensor is closed.

8. Method pursuant to claim 7, wherein when an attempt is made to separate at least one of the bracket component from the product, the mounting component from the mounting point and the bracket component from the mounting component, the measuring loop is opened.

9. Method pursuant to claim 5, wherein the security unit is connectable to a central unit via the connectors, and wherein, in the connection of the security unit to the central unit, a monitoring for proper connection of the security unit to the central unit is activated.

10. Method pursuant to claim 9, wherein, in at least one of attaching the bracket component to the product and connecting the security unit to the central unit, the monitoring is activated, and wherein in the bracket component, a measuring loop comprising sensors is closed.

11. Method pursuant to claim 10, wherein, when an attempt is made to separate at least one of the bracket component from the product and the security unit, the measuring loop is opened.

12. Method for protecting a commercial product against theft, in which a security unit is connected to a central unit via connectors, and in which the central unit has a monitoring mode, in which theft protection is active such that a theft attempt will result in a shift to an alarm mode in which at least one of an acoustic and an optical alarm is activated, the method comprising:

deactivating, in the monitoring mode, a receiver that is housed in the central unit outside of the commercial product; and activating the receiver when the central unit is shifted to the alarm mode, wherein the central unit has an on-state mode, in which the receiver is activated and wherein the system is shifted from the on-state mode to a connect mode in which theft protection is not active when the receiver receives a signal from a transmitter, wherein at least one of the security unit and the central unit are prepared in the connect mode for a transfer to the monitoring mode, and wherein the central unit is shifted from the connect mode to the alarm mode if at least one of the security unit and the central unit have not been prepared within a preset time interval for a shift to the monitoring mode.

13. Method pursuant to claim 12, wherein the alarm mode is terminated when the receiver receives a signal from a transmitter.

14. Method pursuant to claim 12, wherein the receiver is deactivated when the central unit shifts to the connect mode.

15. Method pursuant to claim 12, wherein the central unit is shifted to the on-state mode when the central unit is switched on.

16. Method pursuant to claim 12, wherein a transmitter transmits a selection signal is used to control at least one of termination the alarm mode and shift the security unit to a connect mode in which theft protection is not activated, the selection signal being received by the receiver.

17. Method for pursuant to claim 16, wherein the selection signal is used to terminate the alarm mode and the selection signal is used to shift the system to the connect mode.

18. Method pursuant to claim 16, wherein, to transmit the selection signal from the transmitter to the receiver, a remote operating system is used.

19. Method pursuant to claim 16, wherein the selection signal is transmitted by the transmitter to at least one other transmitter.

20. Method pursuant to claim 12, wherein one or more operating modes for at least one of the security unit and the central unit are indicated via at least one of an optical and acoustic signal.

21. Method pursuant to claim 20, wherein the at least one of the optical and acoustic signal is modulated based upon the amount of time remaining in a time interval.

22. Method pursuant to claim 12, wherein a status of a power source for at least one of the security unit and the central unit is monitored.

23. Method pursuant to claim 22, wherein at least one of an acoustic and optical signal is emitted based upon the status of the power source.

24. Method pursuant to claim 12, wherein at least one of multiple security units and multiple central units are operated using a single transmitter.

25. Method for protecting a commercial product against theft, in which a security unit is connected to a central unit via connectors, and in which the central unit has a monitoring mode, in which theft protection is active such that a theft attempt will result in a shift to an alarm mode in which at least one of an acoustic and an optical alarm is activated, the method comprising:

deactivating, in the monitoring mode, a receiver that is housed in the central unit outside of the commercial product; and activating the receiver when the central unit is shifted to the alarm mode, wherein a transmitter transmits a selection signal that is used to control at least one of termination the alarm mode and shift the security unit to a connect mode in which theft protection is not activated, the selection signal being received by the receiver, and wherein the security unit has an on-state mode in which the receiver is activated and wherein the alarm mode is not terminated if the selection signal received during the alarm mode differs from another selection signal received by the security unit in the on-state mode.

26. Method pursuant to claim 16, wherein the selection signal is encoded.

27. Method pursuant to claim 16, wherein the selection signal is stored in the receiver in a volatile memory.

28. Method for protecting a commercial product against theft, in which a security unit is connected to a central unit via connectors, and in which the central unit has a monitoring mode, in which theft protection is active such that a theft attempt will result in a shift to an alarm mode in which at least one of an acoustic and an optical alarm is activated, the method comprising:

deactivating, in the monitoring mode, a receiver that is housed in the central unit outside of the commercial product; and activating the receiver when the central unit is shifted to the alarm mode, wherein a transmitter transmits a selection signal that is used to control at least one of termination the alarm mode and shift the security unit to a connect mode in which theft protection is not activated, the selection signal being received by the receiver, and wherein the security unit and the central unit are switched off and on in series to transfer a selection signal to the security unit and the central unit, respectively.

* * * * *